US010874954B2

(12) United States Patent
Anderson

(10) Patent No.: US 10,874,954 B2
(45) Date of Patent: Dec. 29, 2020

(54) ROTATIONALLY ENGAGED TOY BRICK SYSTEM

(71) Applicant: Paul Anderson, San Diego, CA (US)

(72) Inventor: Paul Anderson, San Diego, CA (US)

( * ) Notice: Subject to any disclaimer, the term of this patent is extended or adjusted under 35 U.S.C. 154(b) by 0 days.

(21) Appl. No.: 16/075,868

(22) PCT Filed: Aug. 2, 2018

(86) PCT No.: PCT/US2018/045049
§ 371 (c)(1),
(2) Date: Aug. 6, 2018

(87) PCT Pub. No.: WO2019/028277
PCT Pub. Date: Feb. 7, 2019

(65) Prior Publication Data

US 2020/0047077 A1 Feb. 13, 2020

Related U.S. Application Data

(60) Provisional application No. 62/540,463, filed on Aug. 2, 2017.

(51) Int. Cl.
*A63H 33/06* (2006.01)

(52) U.S. Cl.
CPC ..... *A63H 33/067* (2013.01)

(58) Field of Classification Search
CPC ..... A63H 33/06–088
USPC ..... 446/102, 104; D21/484, 486, 499–502; 16/257
See application file for complete search history.

(56) References Cited

U.S. PATENT DOCUMENTS 3,102,367 A * 9/1963 Pedersen ..... E04B 2/08 52/592.2
4,375,139 A * 3/1983 Chatani ..... A63H 17/26 446/471
4,606,732 A * 8/1986 Lyman ..... A63H 33/086 446/104
4,826,464 A * 5/1989 Bertrand ..... A63H 33/042 446/120
5,172,534 A * 12/1992 Milner ..... A63H 33/042 446/104
5,209,693 A * 5/1993 Lyman ..... A63H 33/042 403/157
5,503,497 A * 4/1996 Dudley ..... A63H 33/042 403/103
5,645,463 A * 7/1997 Olsen ..... A63H 33/04 446/104

(Continued)

FOREIGN PATENT DOCUMENTS

GB 2288551 A * 10/1995 ..... A63H 33/042

*Primary Examiner* — Laura Davison
(74) *Attorney, Agent, or Firm* — Donn K. Harms

(57) ABSTRACT

A toy brick system is provided having a plurality of bricks each of which has a post positioned extending from a first end of a body of the brick and having a socket at a second end. The post in each brick in the plurality is engageable with a socket of an adjacently place brick in a removable rotational engagement enabling curved and angled configuration of assembled structures. Engagement and disengagement from the rotational engagement can only occur at a specific engagement angle between adjacent bricks thereby maintaining the rotational engagement of adjacent bricks once engaged and rotated out of the engagement angle.

8 Claims, 7 Drawing Sheets

(56) References Cited

U.S. PATENT DOCUMENTS

| | | | | |
|---|---|---|---|---|
| D394,469 | S * | 5/1998 | Nielsen | D21/500 |
| 10,307,685 | B2 * | 6/2019 | Sorensen | A63H 33/086 |
| 10,378,567 | B2 * | 8/2019 | Acerra | A63H 33/105 |
| 2015/0224416 | A1 * | 8/2015 | Schildknecht Hoe | A63H 17/06 446/104 |

* cited by examiner 10
14
14
14
14
18
12
16
12
16
12
20
22
34
16
12
16
12

38
22
30
34
31
44
12
28

38
22
48
28
48
31

38
22
28
12

12
38
22
28
31
12

22
38
28
X
48
48
49
34
E
12

40

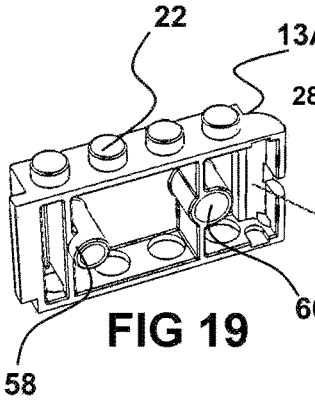
FIG 19
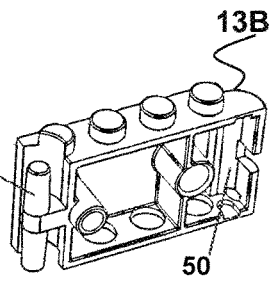
FIG 20
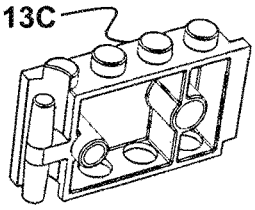
FIG 21
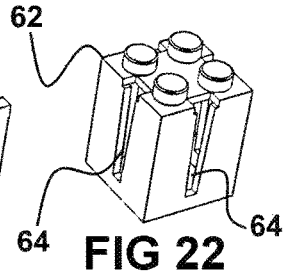
FIG 22
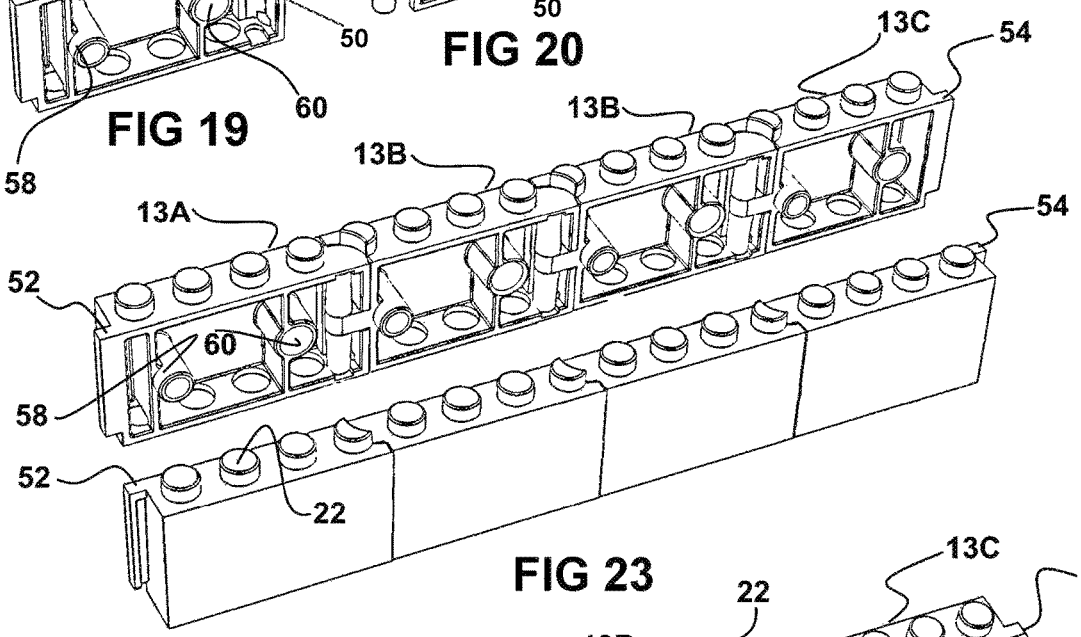
FIG 23
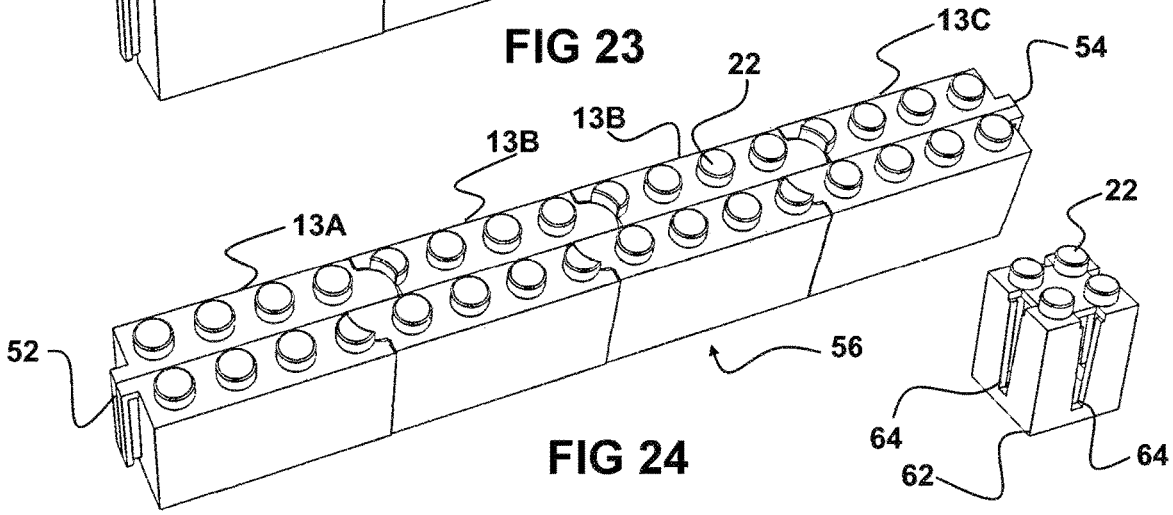
FIG 24
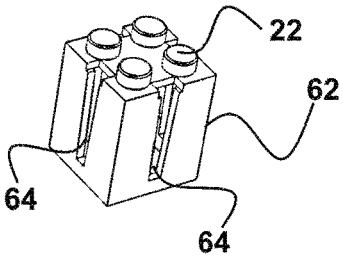

ROTATIONALLY ENGAGED TOY BRICK SYSTEM

FIELD OF THE INVENTION

This application claims priority to U.S. Provisional Patent Application Ser. No. 62/540463 filed on Aug. 2, 2017, which is incorporated herein in its entirety by this reference thereto.

The present device relates to a toy-building block system. More particularly, the device and method herein relates to a toy building block configured with convex and concave ends of adjacent toy building blocks, which so engaged, results in a pivoting block engagement which yields rotation and a substantially gapless sidewall.

BACKGROUND OF THE INVENTION

Toy bricks for building structures have been enjoyed by children and adults alike. Brick systems such as those by LEGO provide brick pieces in a wide variety of sizes, shapes, and colors, which are adapted on two or more side surfaces, to removably engage with corresponding mating surfaces of adjacent brick pieces. Using such removably engageable brick systems, users build many differing types of structures which are limited in type and scope only by the imagination of the builder.

Conventionally, such brick pieces are configured primarily for the formation in substantially linear configurations. That is to say such conventional engageable toy brick systems use linear brick-like components which have sequentially aligned mating connectors and receptors. So configured, such are best adapted to form structures in a linear configuration such as walls and the like. Such conventional self-engaging toy brick systems are also not configured for the formation of elongated and unsupported spans.

The device and system herein, provides a toy brick configuration and engagement system which may be configured in a linear fashion, or may be formed to a pivoting or rotating engagement between the ends of two adjacent complimentary configured toy brick pieces. Thus, conventional linear walls and the like can be formed as well as curved structures. This curving configuration ability is provided by an engageable post at a first end of the toy bricks, which is adapted to rotationally engage with a complimentary socket positioned on one end of an adjacent toy brick. Through the engagement of the post and socket provided, a secure engagement of the ends is achieved which allows for linear or any number of angled positions of the two engaged pieces relative to each other.

This post and socket rotating engagement thus provides a secure connection between brick ends in the system herein which prevents lateral translation of the two engaged brick pieces. However, so engaged, the two pieces can be rotated from a linear orientation to form angled configurations. This angled configuration allows for curved walls and structures.

Still further, through the configuration of the mating faces of both the post end of one brick and the socket end of the adjoining brick, gaps between the two when in an angled engagement are eliminated by the positioning of a curved wall surface in the area of connection between the pivoting post and socket connection.

The forgoing examples of engageable toy bricks for structure building, and limitations related therewith are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The toy brick device and system herein disclosed and described provides a solution to the shortcomings in prior art and achieves the above noted objects through the provision of a toy brick system configured for either a linear engaged configuration or a pivoting engagement allowing for an angled orientation between adjoining toy bricks in the system.

Employing the disclosed toy brick configurations herein, the system allows a plurality of the toy bricks to be removably engaged in a rotational engagement with adjacent toy bricks. The pivoting or rotational engagements are provided at respective opposing ends of each of the respective toy bricks whereby substantially gapless angled wall configurations can be formed.

In all modes of the system the upper surfaces of the toy bricks are configured with a plurality of spaced projections which are adapted to frictionally engage with recesses formed into or depending into, the bottom surface of the respective toy bricks. Adjacent toy bricks may be connected in a rotational engagement by positioning the posts on a first brick in a removable engagement with apertures of the adjoining brick at an engagement angle.

Once rotated from the engagement angle, the two rotationally engaged bricks will not separate. The engagement angle can vary by changing the positioning of slots providing engagements of the projections on the post of one toy brick to a side positioning rather than end positioning.

With respect to the above description, before explaining at least one preferred embodiment of the herein disclosed pivoting toy brick engagement system invention in detail, it is to be understood that the invention is not limited in its application to the details of construction and to the arrangement of the components in the following description or illustrated in the drawings. The toy brick invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other rotationally or pivotally engaged toy brick devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention to provide a secure pivotable engagement between two adjacent toy brick pieces employed in structure building.

It is an additional object of this invention to provide such a pivoting engagement which forms a curved or angled engagement with a minimum or no gap positioned between the ends of the two engaged toy bricks.

These and other objects, features, and advantages of the present toy brick system with rotating brick engagements, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed pivotally engaged play bricks. It is intended that the embodiments and figures disclosed herein are to be considered illustrative of the invention herein, rather than limiting in any fashion.

In the drawings:

FIG. 19 depicts one configuration of a half-brick adapted to engage a mirrored half-brick to form a strut as in FIG. 25.

FIG. 20 shows a configuration of a half-brick mode adapted to engage within the central area of a formed strut in-between the half-bricks shown in FIGS. 19 and 21.

FIG. 21 depicts a mode of half-brick employable to form a strut as in FIG. 25, which is engaged to an opposite end of the strut from that of FIG. 19.

Shown in FIG. 22 is a connector brick configured to engage the projections extending from opposing sides of a strut such as shown in FIG. 24 and provide an interface or engagement to a all structure.

FIG. 23 is a depiction of a plurality of bricks per FIGS. 19-21 positioned for assembly.

Figure 25:
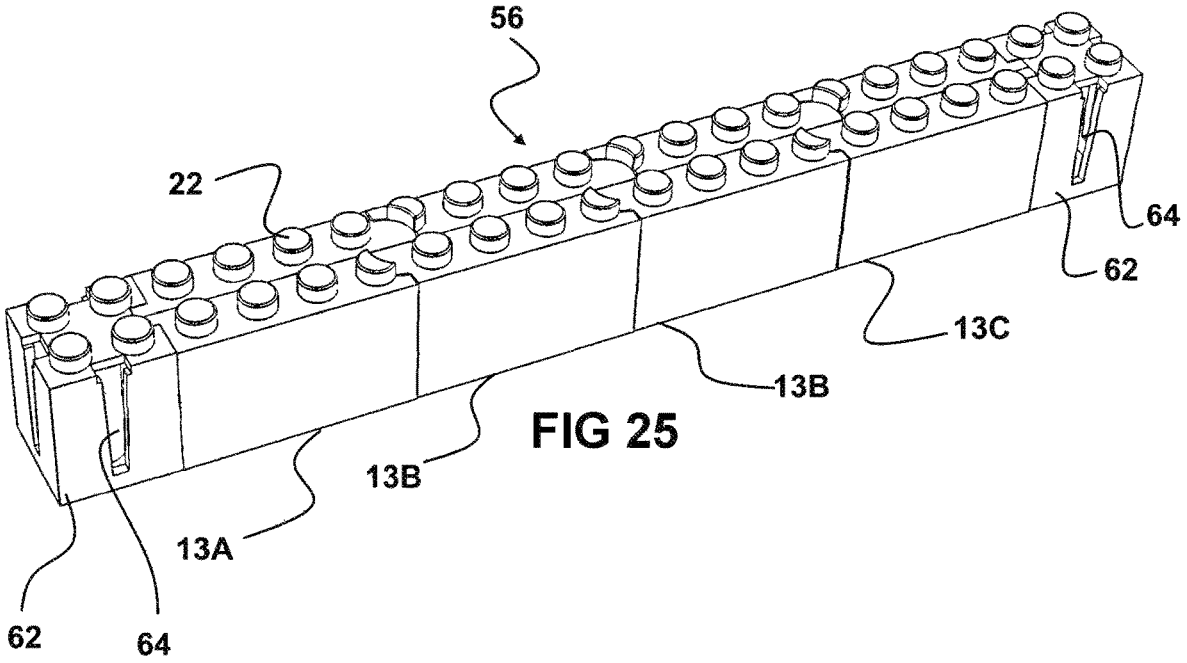

FIG. 25 depicts a formed strut of FIG. 24 formed of the half bricks of FIGS. 19-21 which has the slots formed in the sides of the connector bricks slidably engaged with the projections on opposite sides.

DETAILED DESCRIPTION OF THE INVENTION

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Figures 9, 10, 11, 12, 13, 14:
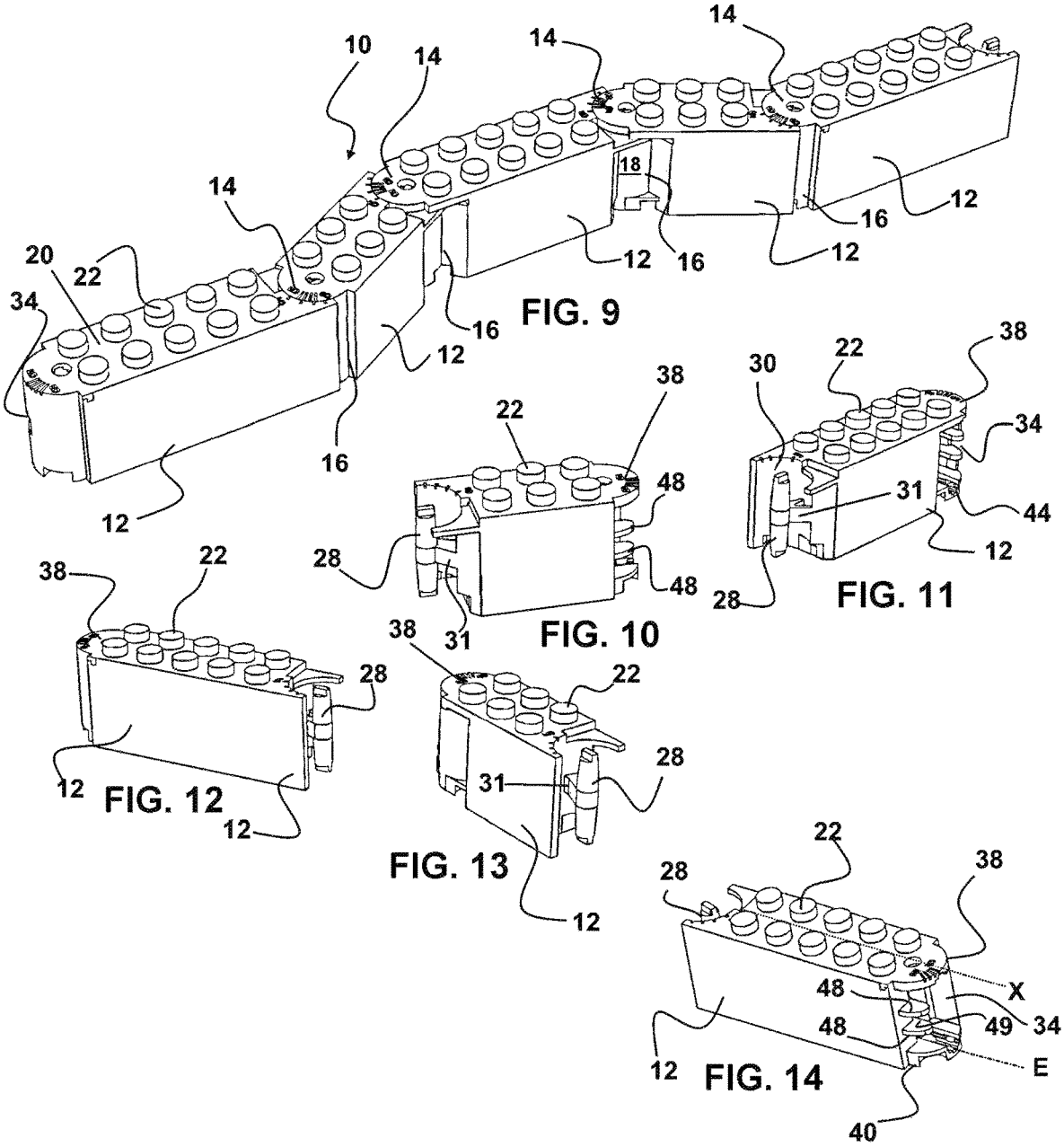
FIG. 9 shows a perspective view of a serpentine configuration of a brick wall which is achieved with the brick system herein and shows that bricks may vary in length and engagement direction.
FIGS. 10-13 depict various perspective views of the bricks engaged in FIG. 9.
FIG. 14 shows the toy brick device herein showing the slot in the socket end, aligned with the longitudinal axis of the toy brick.
Figure 15:
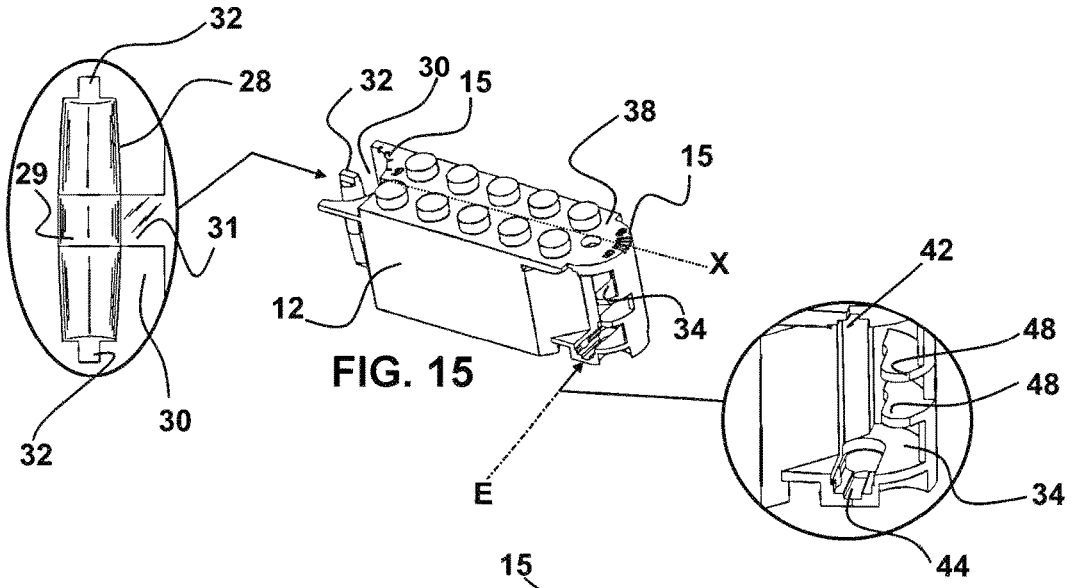
FIG. 15 depicts a particularly preferred mode of the toy brick herein, similar to that of FIGS. 1-4 but showing the slots of the socket end of the brick running substantially perpendicular to the longitudinal axis of that brick, whereby an engagement of a post end of a second brick will require a positioning substantially perpendicular or normal to the longitudinal axis.
Figure 16:
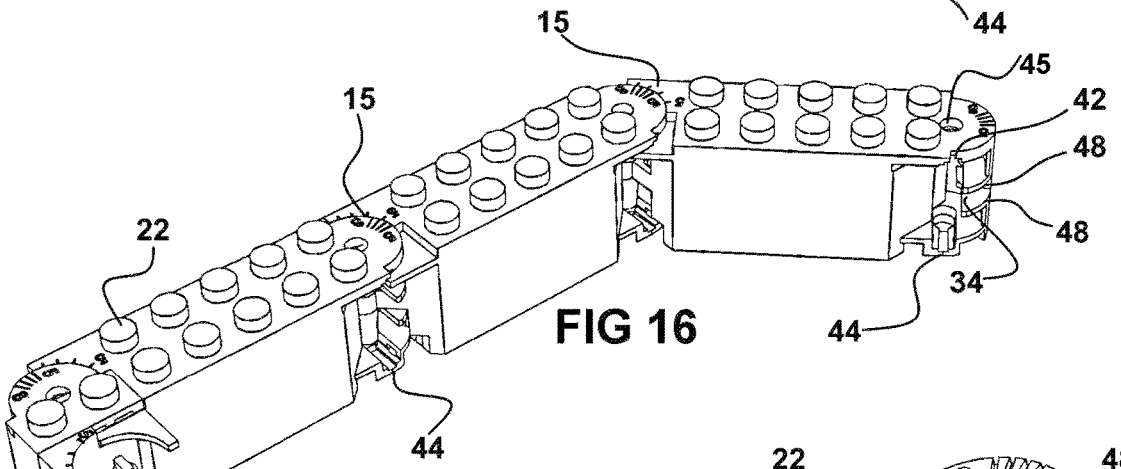
FIGS. 16-18 depict other configurations of the brick system herein which are rotationally engaged employing bricks similar to that of FIG. 15 with a convex end on a first brick rotationally engageable with a concave end on an adjoining brick and which removably engages in a similar fashion to the bricks of FIGS. 1-15.

Now referring to drawings in FIGS. 1-25, wherein similar components are identified by like reference numerals. FIGS. 1-14 depict a group of bricks 12 linked together to form a concave viewing surface such as shown in FIG. 9 where central located bricks 12 are identical while the two end bricks 12 form transitions from the concave to a straight or convex shape of the more commonly used bricks shown in FIGS. 15-18. In FIG. 16 is shown a backside view of commonly used bricks 12 herein that can be arranged as straight beams or closed polygons.

In all preferred modes of the system 10, bricks 12 have a body which is configured with a post 28 at a first end of the body which is configured for a removable rotational engagement with a socket 34 at a second end of the body of adjacent bricks 12. This preferred configuration allows sequentially engaged bricks 12 to form linear configurations as with conventional bricks 12, but to also form angles, curves and other non linear configurations. The bricks 12 may be configured to engage with conventional toy bricks such as those manufactured by LEGO, in that they have projections 22 on a top side and an opposite bottom side adapted to frictionally engaged such projections on an underlying brick 12.

Figure 1:
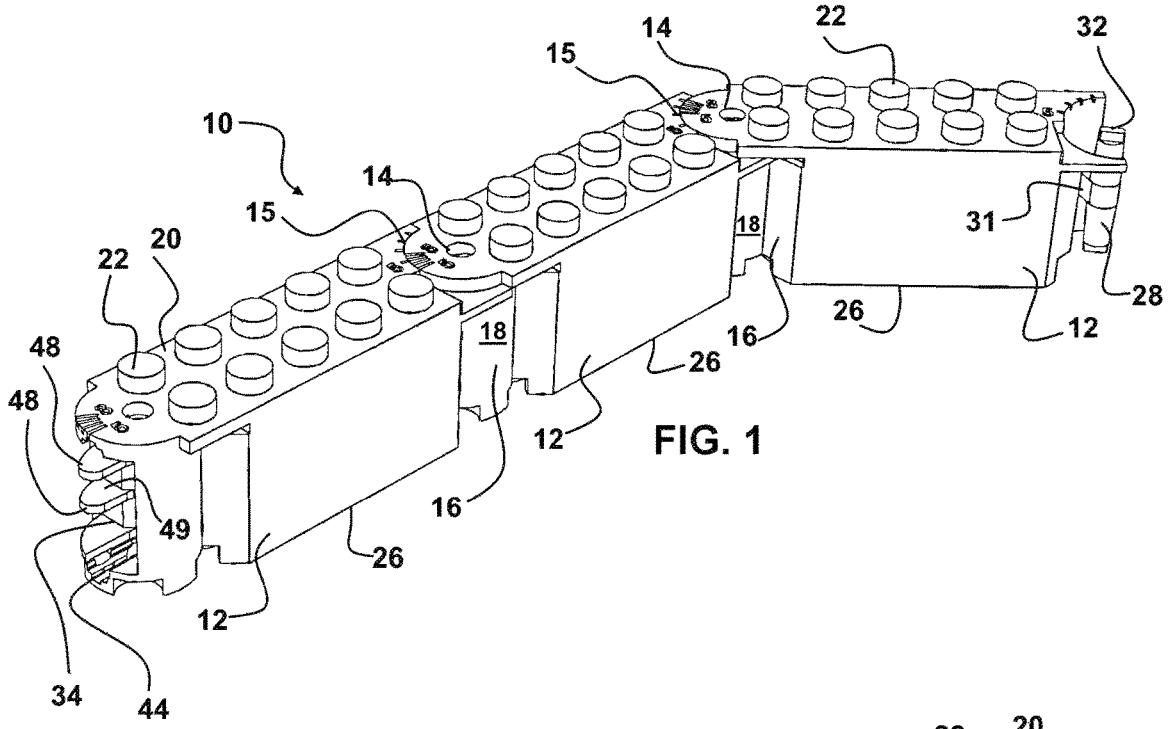
FIG. 1 depicts an exterior perspective view of a plurality of the bricks herein in rotational engagements.

FIG. 1 depicts an exterior perspective view of one mode of the rotational engagement toy brick system 10 herein. The bricks 12 as shown are in an as-used configuration, with a plurality of the toy bricks 12 herein, each in a rotational engagement with adjacent toy bricks 12, at respective opposing ends of the respective bricks 12 and forming the serpentine wall. As can be seen in FIG. 1, the gaps 16 between pivotally connected bricks 12, are substantially filled with a wall surface 18 whether the adjoining bricks are aligned or at a variable angle to each other. Such a filled result of the engaged bricks 12 is preferred as builders of structures with such toy bricks 12 prefer a minimum of unfilled exposed wall surfaces in the resulting structure.

In all modes of the system 10 herein, upper surfaces 20 of the body of the brick 12 preferably include a plurality of spaced projections 22. These projections 22 are positioned and sized to frictionally engage within a recess 27, depending into a bottom of the body of the brick 12. Such a configuration of the projections will frictionally engage them against the wall 25 forming circular recesses 24 (FIGS. 7-8) within the recess 27 in the bottom surface 26 of the respective bricks 12 herein and a sidewall 23 of the body of the brick 12 extending around the recess 27 depending into the bottom of the body of the brick 12.

In a well known frictional engagement configuration such as that employed by LEGO and other conventional bricks, projections 22 extending above the top surface of the body of bricks 12 frictionally engage against and in-between a wall 25 forming the circular recesses 24 and a sidewall 23 of the brick 12 surrounding the recess 27 depending into the bottom of the body of the brick 12. However, such well known conventional engagements of conventional toy bricks 12 lack the rotational engagement ability to form curves and angles resulting in formed structures.

Figure 2:
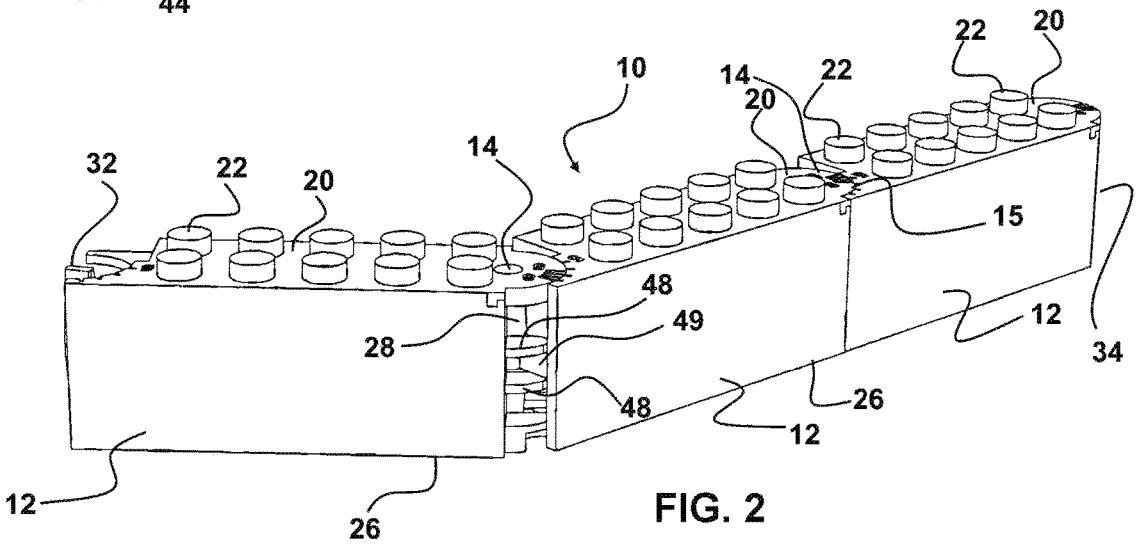
FIG. 2 depicts the opposite side view of the bricks in rotational engagements in FIG. 1.

Shown in FIG. 2, is an opposite side view of the bricks 12 in rotational engagements 14, of FIG. 1. In this rear view, the gap 16 formed between adjacent bricks 12 which are in a removable rotational engagement 14, positioning the bricks 12 at an angle to each other, is generally not visible since the rearward facing surface is not seen in a completed structure formed of the engaged toy bricks 12. Thus, a solid viewable surface is provided such as in FIG. 1, or in FIG. 2 where adjacent bricks 12 are in a straight configuration or in a convex angled configuration, and the rear surface is in a straight or convex configuration.

Figure 3:
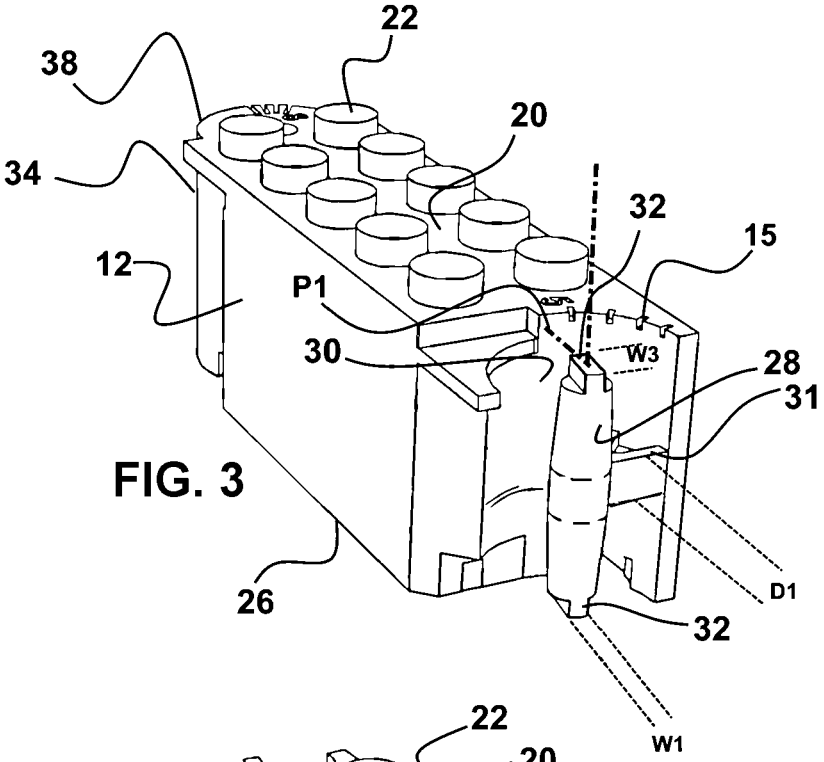
FIG. 3 depicts a perspective end view of the post end of the bricks herein which is adapted for rotational engagement with the socket end shown in FIG. 4.

In FIG. 3, is depicted a perspective end view of a toy brick 12 according to the system 12 herein, which may vary in length. The brick 12 has a first end with a projecting post 28 extending from a centrally located mount 31 which extends between the first end of the brick 12 and the post 28. A recess 30 or void surrounds the entire post 28 but for the area intersected by the mount 31. The mount 31 has diameter D1 extending between the first end of the brick 12 and the post 28.

Preferably in all modes of the brick 12 herein, at opposing ends of the post 28, projections 32 are located. Both elongated projections 32 have a width W1 which is narrower than the width of the post 28 and both projections are axially aligned with each other. These projections 32 in all modes of the system 10 provide a means for removably engaging the post 28 to a rotational engagement on one end of an adjacent brick 12.

Figure 4:
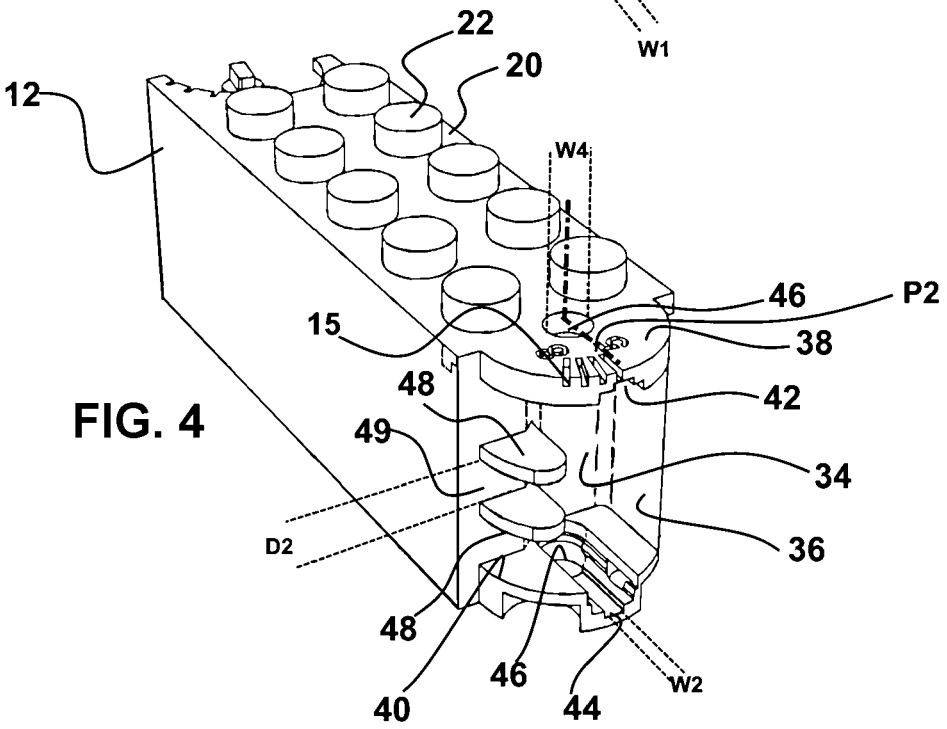
FIG. 4 shows the socket end of the rotational brick system herein which is adapted for pivoting or rotational engagement with the post end noted in FIG. 3.
Figure 5:
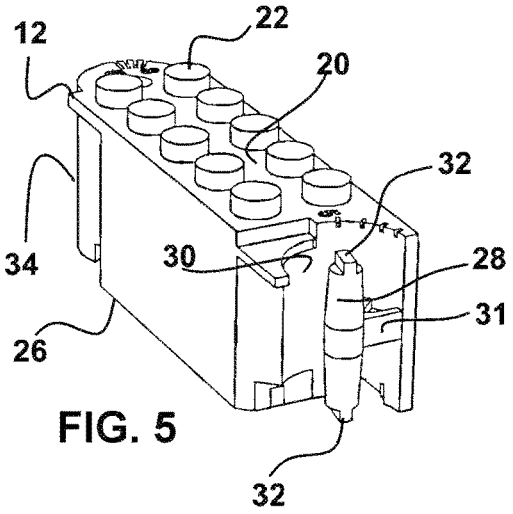
FIG. 5 shows another perspective view of the post end of the rotationally engageable bricks herein similar to that of FIG. 3.
Figure 6:
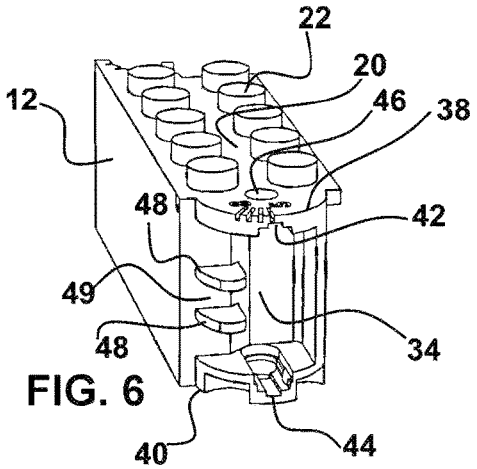
FIG. 6 depicts another perspective view of the socket end of the rotationally engageable bricks herein.
Figure 7:
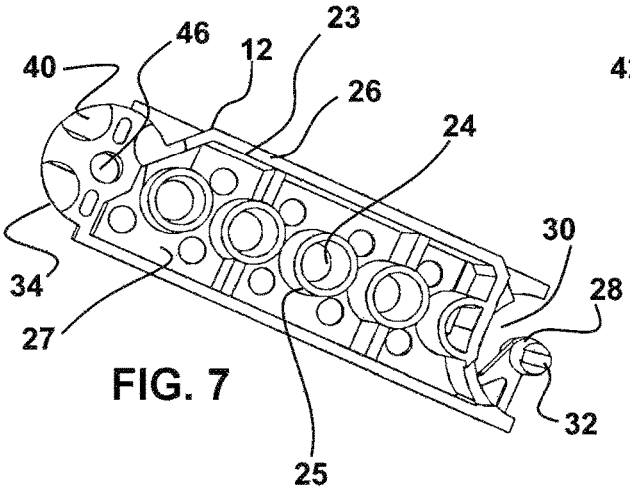
FIG. 7 shows a bottom perspective view of the device as depicted in FIG. 5.
Figure 8:
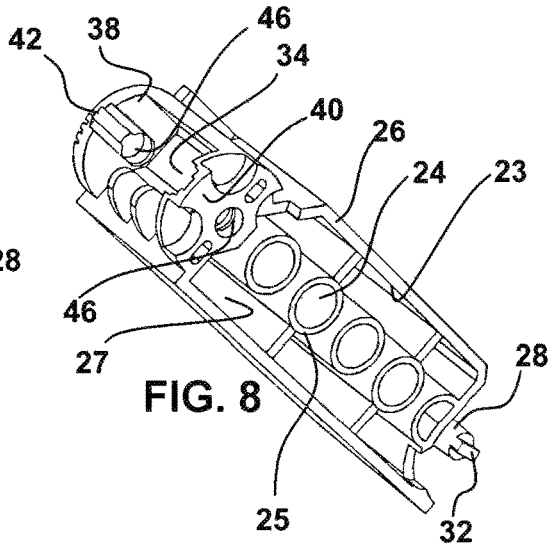
FIG. 8 shows a view of the device as in FIG. 7 at a differing perspective angle.

In FIG. 4 is depicted a preferred configuration of a second end, or the socket end, of the bricks 12 in all modes of the brick system 10 herein, showing a socket 34 adapted to removably rotationally engage the post 28 of an adjoining brick 12. As can be seen in the drawings, the length of the bricks 12 may vary, but at the second end of the rotationally engageable bricks 12, there will be positioned a socket 34. This socket 34 is configured for removable rotationally engagement with the post 28 at a first end, or post end, of any adjacent positioned bricks 12. In all modes of the system 10, as noted herein, the engagement and removal of this rotational engagement of the post 28 in a socket 34 is only achievable when the angle of the axis X of two adjoining bricks 12, is at an engagement angle E, which is shown and described in detail herein.

As shown, a recess 36 depends into the second end of the brick 12. This recess 36 is located between a first flange 38 extending adjacent the top, and a second flange 40 extends away from the bottom. A first slot 42 depends into one side of the first flange 38, and a second slot 44 depends into a side facing the first flange 38 on the second flange 40. Both the first slot 42 and second slot 44 run along a line aligned with or parallel with the axis X (FIG. 14) of the brick 12. Thus, both slots are aligned.

Both slots 42 and 44 intersect respective apertures 46 communicating through the first flange 38 and second flange 40. Both apertures 46 are axially aligned and have a width W4, defined by the diameter of the apertures 46. This aperture width or diameter W4 is preferably substantially equal to, or slightly larger than, a length W3 of the projections 32 from end to end. This substantially equal or slightly larger length W3 allows the projections 32 to rotate in an rotational contacting engagement within the inside wall of the apertures 46.

As shown, in all modes of the bricks 12 of the system 10 herein, the projections 32 will only slide through the first and second slots 42 and 44 and into a rotating engagement within an aperture 46 when the two bricks 12 are at an engagement angle E to each other. This engagement angle E can vary but currently a preferred range is between 60-90 degrees, with the engagement angle E preferably being closer to 90 degrees such as shown in FIG. 15 because it allows for the most number of angles achievable by two engaged bricks 12 since once the two are rotated to any angle less than 90 degrees, they will not disengage.

This removable rotational engagement allows the projections 32 to be slid along the first slot 42 and second slot 44 and into the apertures 46 when the two bricks 12 are at the engagement angle E, such as 90 degrees, and prevents disengagement, so long as the two bricks 12 are at any angle relative to each other less than the engagement angle E, such as 50 degrees where the engagement angle E, is 60 degrees, or 85 degrees where the engagement angle E, is 90 degrees.

As shown, when in this rotational engagement such as shown in FIGS. 1-2, 9 and 16, the two adjacent removably rotationally engaged bricks 12, are held in the same plane by the automatic positioning of the mount 31, within the gap 49 (FIG. 4) in-between guides 48. As shown, the gap 49 has a gap having a gap diameter D2, which is substantially equal to, or just slightly larger than, the width or diameter D1 of the mount 31 holding the post 28. This allows the upper and lower side edges of the mount 31 to slide in the gap 49 adjacent to or contacting the facing surfaces of the guides 48. During rotation of the rotationally engaged bricks 12, this engagement of the mount 31 between the guides 48, holds the two bricks 12 in the same plane during such a rotation.

In all modes of the system herein, the engagement of two bricks 12 preferably includes pre-loading which imparts friction to prevent rotation without force being imparted to the bricks 12. This pre-loading forms a more secure engagement when building and is currently preferably accomplished by a slight reduction in the spacing distance P2 and P1, of the post 28 and socket center lines. For example, formation of at least the first flange 38 sufficiently long that it contacts the wall defining the recess 30 and imparts a load or friction to rotation by the frictional contact of the edge of the first flange 38 against the wall of the recess 30.

Alternatively or in combination, a frictional contact of the side of the post 28 against the interior sidewall surface of a mated aperture 46 can provide frictional resistance and pre loading. Thus, once engaged, the post 28 will impart friction against the sidewall of the aperture 46, and the sidewall of the flange 38 will frictionally contact against the wall of the recess 30 to allow for a forced movement by the user but maintain the angle of the two bricks 12 to each other without force. Still further, a pre-loading structure can be provided by the surfaces of the guides 48 facing the rotating post 28 which can be formed to contact against the post 28 and provide a pre-loading or resistance to rotation.

In this pre-loading, the dimensions of the concave and convex ends of the bricks 12 establish the length of the brick pair. Reducing that spacing provides axial pre-load developed by contact of the flange 38 against the wall of the recess 30 which flexes the posts 28 similar to that of the bow of an archer. This pre-load force will develop resistance to axial bending, tensile torsion, and shear forces applied between the bricks. This pre-loading is preferred in all modes of the device 10 because it is desirable to stiffen beams formed of sequentially engaged bricks 12 or to stabilize hexagonal or other shaped rings of bricks.

Additionally seen in the figures, and enlarged in FIGS. 1-3, for example, are the angle indicators 15. These angle indicators 15 are employable to accurately gauge the angular configuration between each of two adjoining bricks 12. Further, the angle indicators 15 are especially helpful when building interesting columns formed of aligned rings of five or more bricks 12 which can be made from stacking rings of bricks. These ring configurations can vary in size due to the number of bricks 12 and/or the length of the bricks 12. Using layer-to-layer spacers, these rings can be assembled to form twisted columns.

FIGS. 5-8 depict various views of the bricks 12 shown above in FIGS. 1-4. These views provide a first end view and a second end view as well as perspective views of the various components of the bricks 12 herein.

Shown in FIG. 9 is a perspective view of a serpentine configuration of a wall formed of differently configured rotationally engaged bricks 12 herein. As can be seen, the bricks 12 can vary in length to provide more options to the builder. No matter the length, each brick 12 will have a recess 30 on one end, with a post 28 engaged therein, and upper flanges 38 and lower flanges 40 on the other end configured to rotationally engage with the post 28 once connected while in the engagement angle E. However, the bricks 12 can vary in length, number of projections 22, and forward and reverse configurations.

Each rotationally engaged brick 12 is freely pivotable by a slight force exerted by the user to rotate one or both bricks 12 to desired angles of the rotational engagement, to form the different angled portions of the completed wall. Angles of the differently configured engaged bricks 12 can require reverse configuration, or different engagement angles E, or longer or shorter bricks 12 as depicted in FIGS. 10-14, and other configurations.

FIGS. 10-14 show the varied size of the individual bricks 12 of those forming the wall in FIG. 9 and showing the differing lengths thereof. Also shown in FIG. 14 is a positioning of the first slot 42 and second slot 44 which are parallel to the center axis X of the brick 12. This configuration provides for engagement with a post 30 of an adjoining brick 12, which is positioned at an engagement angle E, to the axis X of the brick 12.

As shown in FIG. 15, particularly in the enlarged area views, the first slot 42 and second slot 44 both are formed in this mode to run perpendicular to the axis of the brick 12. This configuration requires that the projections 32 on the post 28 of an engaging brick 12, engage and slide along the first slot 42 and second slot 44 into the apertures 46, along a line running perpendicular to the axis X of the brick 12. This changes the engagement angle E where the two bricks 12 engage and then later disengage. At all angles less than engagement angle E, such as any angle less than 90 degrees, the projections 32 remain locked in rotational engagement within the apertures 46.

Also shown in FIG. 15 is an enlarged view of the post 28. As can be seen, the diameter of the post 28 tapers toward the opposing ends of the post 28. A central area 29 of the post 28 where it engages the mount 31, is slightly larger in diameter and circumference than the post 28 on either side thereof. In another or an additional mode of pre-loading a rotational engagement of bricks 12, the central area 29 can be formed with a diameter which causes the exterior surface of the post 28 at or adjacent the central area 29 to contact against one or both guides 48.

FIG. 16 shows a series of bricks 12 configured as in FIG. 15, engaged sequentially. Also shown is a shortened brick from FIG. 18 which is rotationally engaged with the post 28 on the brick 12 at the straight end of the structure.

Figure 17:
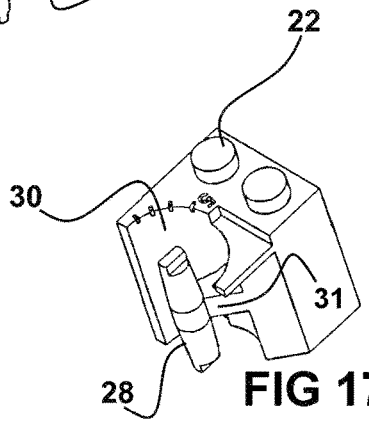

FIG. 17 depicts a shortened brick having the post 28 on one end adapted to engage along a first slot 42 and second slot 44 and into aligned apertures 46 of another of the bricks 12 herein.

Figure 18:
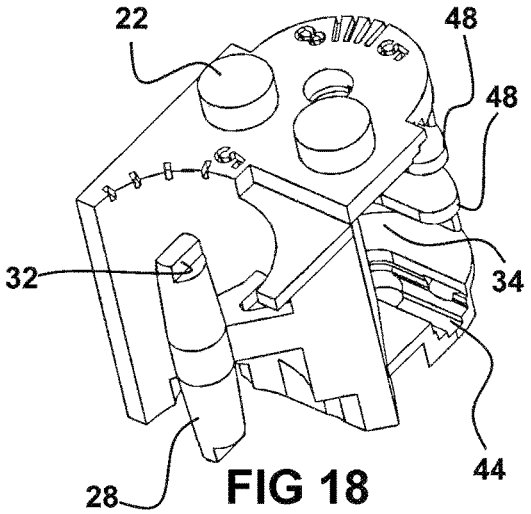

FIG. 18 is similar in configuration to the brick of FIG. 17, but also includes the opening having aligned first and second slots 42 and 44, which allow for a sliding of the projections 32 of a post 28 there along while in an engagement angle E, to rotationally engage within apertures 46 at the end of the two slots.

FIGS. 19-21 show a plurality of differently configured half-bricks 13 which are configured to engage to each other in a sequence such as shown in FIG. 23. In FIG. 19 the half-brick 13A is shown which has a slot 50 at one end adapted to engage with the post 28 such as shown on the half-brick 13*b* in FIG. 20 or the half-brick 13C as shown in FIG. 21. The half brick 13A shown in FIG. 19 has a first projection 52 extending away from the end opposite the end having the slot 50.

Shown in FIG. 20 is half-brick 13B which as noted is configured to engage an adjacent half brick slot 50 with a post 28 thereon. In a beam or strut or the like formed of the half-bricks in FIGS. 19-21, the half-brick 13B shown in FIG. 20, will generally be used to lengthen the formed structure by engaging more or less in between a first end of the formed strut at a half-brick 13A and a second end of the formed strut formed by half-brick 13C shown in FIG. 21.

As can be seen, the first projection 52 extends from the half-brick 13A of FIG. 19 and a second projection 54 extends from the end of half-brick 13C of FIG. 21, at an end opposite the post 28. Thus, an assembled strut or beam or other linear support structure formed by engaging half bricks shown in FIG. 24 will have a first projection 52 at one end of the formed structure and a second projection 54 extending from the other end of the formed linear structure. The length of the formed structure such as in FIG. 24 can be adjusted by insertion of more or less of the centrally located half-bricks 13B of FIG. 20, or of course by using half-bricks which are shorter or longer in overall length.

Shown in FIG. 23 are the components to form a substantially rigid beam or strut 56 or the like as shown in FIG. 24. As can be discerned, a first elongated half strut is formed by a first plurality of half-bricks 13A, 13B, and 13C, and an elongated half strut is also formed in a mirror image of the first elongated half strut. Each of the half bricks has a pin 58 projecting therefrom, and a cavity 60 adapted for frictional engagement of a pin 58 from a mating half-brick. As such, with two half struts formed as in FIG. 23, they can be removably engaged in a rigid structure forming a strut 56 as in FIG. 24, by the engagement of the pins 58 on the half bricks on one of the half struts, with the cavities aligned therewith on the opposite second half strut. Once so engaged, a strong and rigid strut 56 is formed such as is shown in FIG. 24.

Shown in FIG. 22 and in FIG. 24, are connector bricks 62. These connector bricks have a top surface having a plurality of projections 22 extending therefrom which will engage into the recess formed in the bottom of all the other bricks 12 shown herein, and frictionally contact against the wall 25 forming the recesses 24 on such bricks 12 and the sidewall 23 extending around the recess 27 in the bottom of the bricks 12. The bottom surface of the connector bricks 62 is similarly configured to that of the bricks 12 shown in FIGS. 7-8 which as noted is the bottom brick configuration of all the bricks 12 shown herein such as those of FIGS. 3-6 and FIGS. 15-16 and the depicted engagements thereof. Thus it will easily engage the connector brick 62 with the projections 22 on the top surface of any of the depicted bricks 12 or 13A-C herein.

The connector bricks 62 have a plurality of engagement slots 64 preferably formed in all of four sides of the connector bricks 62. These engagement slots 64 are configured to frictionally engage either of the first projection 52 or the second projection 54 of a formed strut 56 shown for example in FIG. 24. Thus the connector bricks 62 provide for an engagement of the opposing ends of a formed strut 56 to a wall structure formed by the bricks 12 herein or in some instances with the projections 22 extending from an upper surface of a formed strut 56.

It should be noted that any of the different depicted and described configurations and components of the toy brick system 10 herein, can be employed with any other configuration or component shown and described as part of the device herein. Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A toy brick system comprising:

a plurality of bricks each having a body;

said body having a first end opposite a second end and having a top surface opposite a bottom;

said body having a longitudinal axis extending between said first end and second end thereof;

a plurality of projections extending above said top surface;

a recess depending into said bottom;

a post positioned on a mount at said first end of said body;

said post having a first elongated projection extending from a first end thereof, and having a second elongated projection extending from a second end thereof opposite said first end thereof;

said first elongated projection being aligned with said second elongated projection;

said post having a post axis running in a direction perpendicular to said top surface;

a socket positioned at the second end of said body;

said socket positioned between a first surface of a first flange extending from said second end of said body, and a first surface of a second flange extending from said second end of said body;

a first elongated slot formed into the first surface of said first flange;

a second elongated slot formed into the first surface of said second flange, said second elongated slot being aligned with said first elongated slot;

said post at said first end of said body of a first brick of said plurality of bricks, having said first elongated projection aligned with said first elongated slot of a second brick from said plurality of bricks, and having said second elongated projection aligned with said second elongated slot of the second brick, being engageable to a rotational engagement, with said socket of the second brick from said plurality of bricks; and whereby sequentially placed bricks from said plurality of bricks can be placed in a respective said rotational engagement to form curved structures.

2. The toy brick system of claim 1, additionally comprising each brick in said plurality of bricks having said plurality of projections extending above said top surface thereof, said plurality of projections configured to engage in a removable frictional engagement into a respective recess depending into said bottom of another of said plurality of bricks.

3. The toy brick system of claim 2, additionally comprising a first guide extending from said second end of said body of said brick into said socket;

a second guide extending from said second end of said body of said brick into said socket;

a gap between said first guide and said second guide;

said mount for said post having a width equal to or slightly smaller than a width of said gap; and said mount being positioned within said gap between said first guide and said second guide when said post at said first end of said first body of said first of said plurality of bricks is positioned in said rotational engagement in said socket on said second end of said second brick of said plurality of bricks.

4. The toy brick system of claim 1, additionally comprising:

said post having a central area, said central area positioned in-between said first end and said second end of said post; and said mount extending between said central area of said post and said first end of said body.

5. The toy brick system of claim 4, additionally comprising said first elongated slot running from an edge of said first flange into a first aperture communicating through said first flange;

said second elongated slot running from an edge of said second flange into a second aperture communicating through said second flange; and said rotational engagement between said first of said plurality of bricks and said second of said plurality of bricks, having said first elongated projection in a rotational engagement within said first aperture and said second elongated projection in a rotational engagement within said second aperture.

6. The toy brick system of claim 5, additionally comprising a first guide extending from said second end of said body of said brick into said socket;

a second guide extending from said second end of said body of said brick into said socket;

a gap between said first guide and said second guide;

said mount for said post having a width equal to or slightly smaller than a width of said gap; and said mount being positioned within said gap between said first guide and said second guide when said post at said first end of said first body of said first of said plurality of bricks is positioned in said rotational engagement in said socket on said second end of said second brick of said plurality of bricks.

7. The toy brick system of claim 4, additionally comprising a first guide extending from said second end of said body of said brick into said socket;

a second guide extending from said second end of said body of said brick into said socket;

a gap between said first guide and said second guide;

said mount for said post having a width equal to or slightly smaller than a width of said gap; and said mount being positioned within said gap between said first guide and said second guide when said post at said first end of said first body of said first of said plurality of bricks is positioned in said rotational engagement in said socket on said second end of said second brick of said plurality of bricks.

8. The toy brick system of claim 1, additionally comprising:

a first guide extending from said second end of said body of said brick into said socket;

a second guide extending from said second end of said body of said brick into said socket;

a gap between said first guide and said second guide;

said mount for said post having a width equal to or slightly smaller than a width of said gap; and said mount being positioned within said gap between said first guide and said second guide when said post at said first end of said first body of said first of said plurality of bricks is positioned in said rotational engagement in said socket on said second end of said second brick of said plurality of bricks.

* * * * *